US006088853A

United States Patent [19]

Jansen

[11] Patent Number: 6,088,853

[45] Date of Patent: Jul. 18, 2000

[54] SLATTED BASE, IN PARTICULAR FOR A BED

[75] Inventor: Klaus Hans Jansen, Buxtehude, Germany

[73] Assignee: Thomas Beteiligungs-und Vermogens GmbH & Co. KG, Germany

[21] Appl. No.: 09/079,248

[22] Filed: May 14, 1998

[30] Foreign Application Priority Data

May 23, 1997 [DE] Germany ..... 197 21 653
Jun. 30, 1997 [DE] Germany ..... 197 27 752

[51] Int. Cl.[7] ..... A61G 7/015

[52] U.S. Cl. ..... 5/618; 5/616

[58] Field of Search ..... 5/613, 616, 618

[56] References Cited

U.S. PATENT DOCUMENTS

| | | | |
|---|---|---|---|
| 3,237,212 | 3/1966 | Hillenbrand et al. | 5/616 |
| 3,593,350 | 7/1971 | Knight | 5/616 |
| 3,821,821 | 7/1974 | Burst et al. | 5/616 |
| 3,898,702 | 8/1975 | Goodman | 5/618 |
| 4,120,057 | 10/1978 | Neumann | 5/616 |
| 5,063,623 | 11/1991 | Bathrick et al. | 5/616 |
| 5,537,701 | 7/1996 | Elliot | 5/616 X |

FOREIGN PATENT DOCUMENTS

| | | |
|---|---|---|
| 25 25 450 | 10/1983 | France . |
| 23 53 054 | 10/1973 | Germany . |
| 87 16 122 | 1/1988 | Germany . |
| 94 12 859 | 10/1994 | Germany . |

*Primary Examiner*—Michael Trettel
*Attorney, Agent, or Firm*—Technoprop Colton LLC

[57] ABSTRACT

The invention relates to a slatted base, in particular for a bed, having a frame and having a plurality of elements which are connected to one another in an articulated manner, at least one element being pivotable in relation to the or every other element. In order to ensure with minimum outlay that, when an element is pivoted, the relative position of a person resting on the slatted base, for example in relation to a bedside cabinet or the like, does not change, the elements are designed to be horizontally displaceable in relation to the frame. An element to be pivoted is furthermore connected to the frame via at least one coupling member. When the element is pivoted, a free end thereof can be moved upwards and downwards in the vertical direction and cannot be displaced in the horizontal direction.

9 Claims, 8 Drawing Sheets

38
39
40
41
42
43
44
45
46
47
48
50
51
53
54
55
56
57
58
59
60
61
62
63
64

SLATTED BASE, IN PARTICULAR FOR A BED

BACKGROUND OF THE INVENTION

1. Technical Field

The invention relates to a slatted base, in particular for a bed, having a frame and having a plurality of elements which are connected to one another in an articulated manner, at least one element being pivotable in relation to the or every other element.

2. Prior Art

Slatted bases of the type mentioned at the beginning are known in sufficient detail. The elements of the slatted base which are connected to one another in an articulated manner serve to support different parts of the body of a person lying on the slatted base. An element which supports the head and upper body is usually described as the top element. In contrast, an element which supports the feet and legs is described as the foot element. In known slatted bases, at least one further element is arranged between the top element and the foot element, which further element serves to support the seat part and is described as the seat element.

In known slatted bases, when an element, in particular the top element, is pivoted, a free end of the top element is moved on an arcuate path. This changes the distance between the upper body of a person lying on the slatted base and, for example, a bedside cabinet arranged next to the slatted base. Consequently, when the slatted base has been pivoted, it is difficult for the person lying on the slatted base to reach the bedside cabinet as a result of the change in distance. This is a disadvantage.

BRIEF DESCRIPTION OF THE INVENTION

Setting out from the above, the present invention is based on the problem of providing a slatted base which, on the one hand, avoids the disadvantage described above and, on the other hand, can be produced with little constructional outlay.

To solve this problem, the slatted base mentioned at the beginning is characterized in that an element to be pivoted is connected, in particular, to a frame via at least one coupling member in such a way that, when the element is pivoted, a free end thereof can be moved upwards and downwards in the vertical direction and cannot be displaced in the horizontal direction, and the other elements are essentially horizontally displace able in relation to the frame.

Consequently, the invention is based on the concept of not moving the free end of the element to be pivoted on an arcuate path, but on a vertical path. The horizontal component of the movement of the free end, which usually occurs when the element is pivoted, is compensated by the horizontal displaceability of the elements in relation to the frame. The coupling member is important in this context since it brings about the horizontal displacement of the elements in relation to the frame when the element is pivoted. This solution involves particularly simple constructional outlay.

Preferred developments of the invention emerge from the subclaims and the description. Preferred exemplary embodiments of the invention are explained in greater detail with reference to the drawings, in which:

DETAILED DESCRIPTION OF THE PREFERRED EMBODIMENTS

Figure 1:
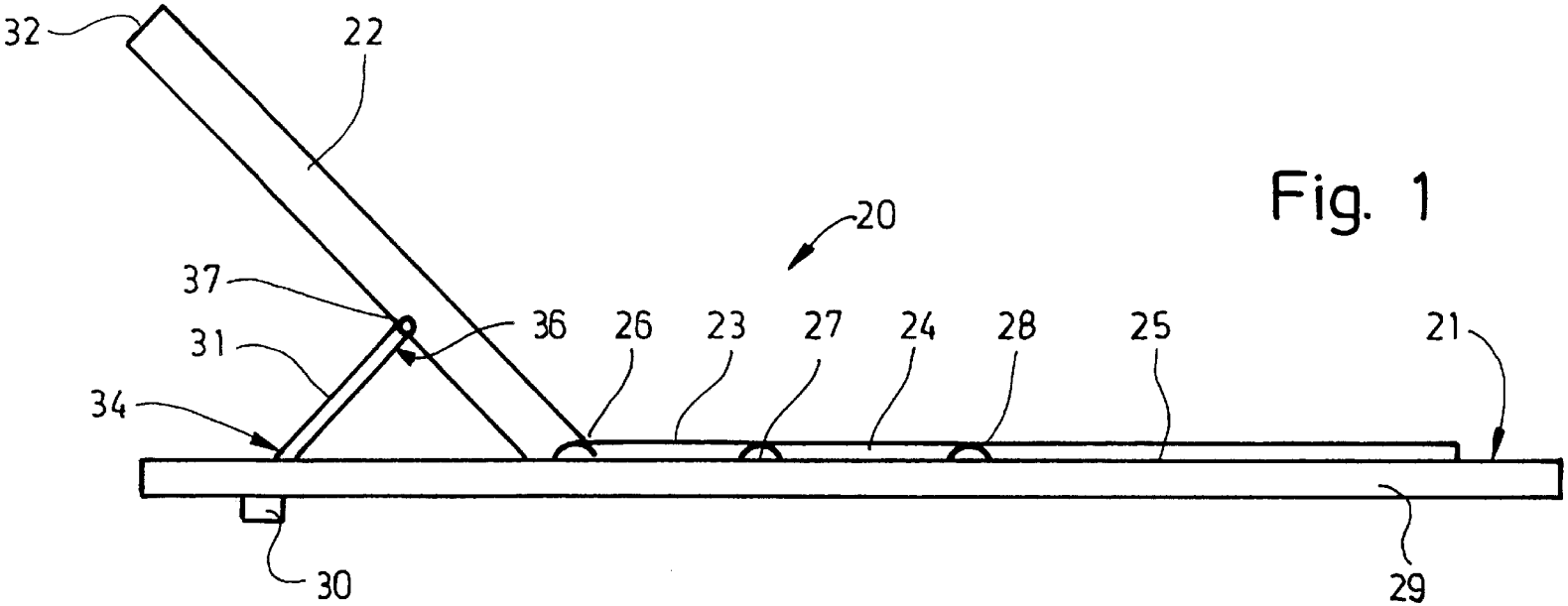
FIG. 1 shows a slatted base according to a first exemplary embodiment of the invention with a top element which has been pivoted into an oblique position, in a side view.

The slatted bases illustrated in the drawing are used, above all, for beds, hospital beds or the like. They are used to support a person lying on the bed or in a hospital bed.

FIGS. 1 to 8 show a slatted base 20 according to a first exemplary embodiment of the invention in different illustrations. The slatted base 20 shown in those figures has a frame 21 and four elements 22, 23, 24, 25 which are connected to one another in an articulated manner. The frame 21 does not have to be an integral part of the slatted base 20. It may also form the body of the bed or the like on which the elements 22, 23, 24, 25 are supported. The slatted base 20 is then formed essentially only from the elements 22, 23, 24, 25. Two respectively adjacent elements 22, 23 or 23, 24 or 24, 25 are connected to one another in each case by means of a joint 26 or 27 or 28 respectively. The frame 21 is formed by two longitudinal bars 29 extending parallel to one another and transverse bars 30 extending at right angles to the longitudinal bars 29.

The elements 22, 23, 24, 25 of the slatted base 20 serve to support different parts of the body of a person (not illustrated) resting on the slatted base. In this case, the lateral or outer element 22 serves to support an upper body and head of the person lying on the slatted base 20 and is therefore also described as the top element. The likewise outer or lateral element 25, in contrast, serves to support the feet and legs of the person resting on the slatted base 20 and is therefore also described as the foot element. The elements 23, 24 are arranged between the outer or lateral elements 22, 25—that is to say between the top element and foot element. The elements 23, 24 of the slatted base 20 serve to support a seat and the thighs of the person resting on the slatted base 20. The element 23 is therefore usually also described as the seat element, and the element 24 as the thigh element.

The particular feature of the slatted base 20 is to be seen in the fact that, on the one hand, the elements 23, 24, 25 are designed to be displaceable in the horizontal direction in relation to the frame 21 and, on the other hand, the element 22 to be pivoted—that is to say the top element—is connected on both sides thereof to the frame 21 via a coupling member 31 in each case. This ensures that, when the element 22 is pivoted, a free end 32 of the element 22 is moved upwards and downwards solely in the vertical direction. The component of the movement in the horizontal direction, which usually occurs when the element 22 is pivoted, is compensated, so that the free end 32 of the element 22 cannot be displaced in the horizontal direction.

To ensure the horizontal displaceability of the elements 22, 23, 24, 25 in relation to the frame 21, the element 23—that is to say the seat element—is mounted on the frame 21 so as to be horizontally displaceable. For this purpose, guide rails 33 are arranged on the longitudinal bars 29 of the frame 21 and are fixed so as to be non-displaceable on the longitudinal bars 29 of the frame 21. The element 23 is mounted so as to be horizontally displaceable in the said guide rails 33. For this purpose, the joints 26, 27, which bound the element 23 laterally, engage with means which are not illustrated in detail in the guide rails 33. It is likewise possible for the joints 26, 27 to slide along on guide rails configured at right angles.

On account of the element 23 being mounted so as to be horizontally displaceable in the guide rails 33, all the elements 22, 23, 24, 25 are displaceable in the horizontal direction in relation to the frame 21. This results from the fact that the elements 22, 23, 24, 25, that is to say all the elements, are connected to one another by means of the joints 26, 27, 28. On account of the horizontal displaceability of the element 23 and the connection of the elements 22 and 23 by means of the joint 26, a part of the element 22 is also horizontally displaceable during the pivoting movement, even despite the free end 32 of the pivotable element 22 being non-displaceable in the horizontal direction. Wherever the horizontal displaceability even of the element 22 is mentioned, this excludes the free end 32 of the element 22 which, according to the invention, can only be moved upwards and downwards essentially vertically when the element 22 is pivoted.

The coupling member 31 is connected, on the one hand, to the element 22—that is to say to the top element—and, on the other hand, to the frame 21. The coupling member 31 is connected by a first end section 34 to the frame 21, namely to the transverse bar 30 of the frame 21, by means of a first joint 35. The coupling member 31 is connected by a second end section 36, located opposite the first end section 34, to the element 22 to be pivoted—that is to say to the top element—by means of a second joint 37. In this case, the first joint 35 is arranged on the frame 21, namely on the transverse bar 30, in a stationary manner. The second joint 37 can be pivoted in relation to the frame 21 together with the element 22.

Figure 2:
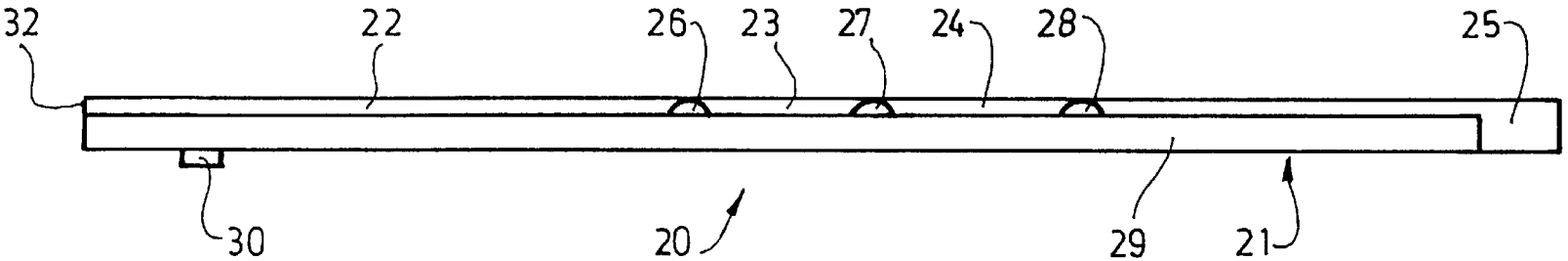
FIG. 2 shows the slatted base of FIG. 1 with a top element which has been pivoted into a horizontal position, likewise in a side view.
Figure 3:
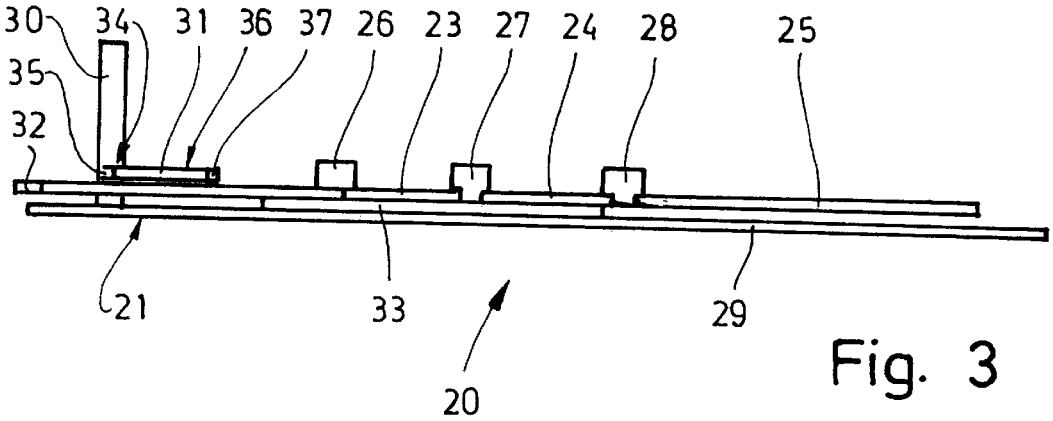
FIG. 3 shows the slatted base according to FIGS. 1 and 2 with a top element which has been pivoted into the inclined position, in a partial plan view.
Figure 4:
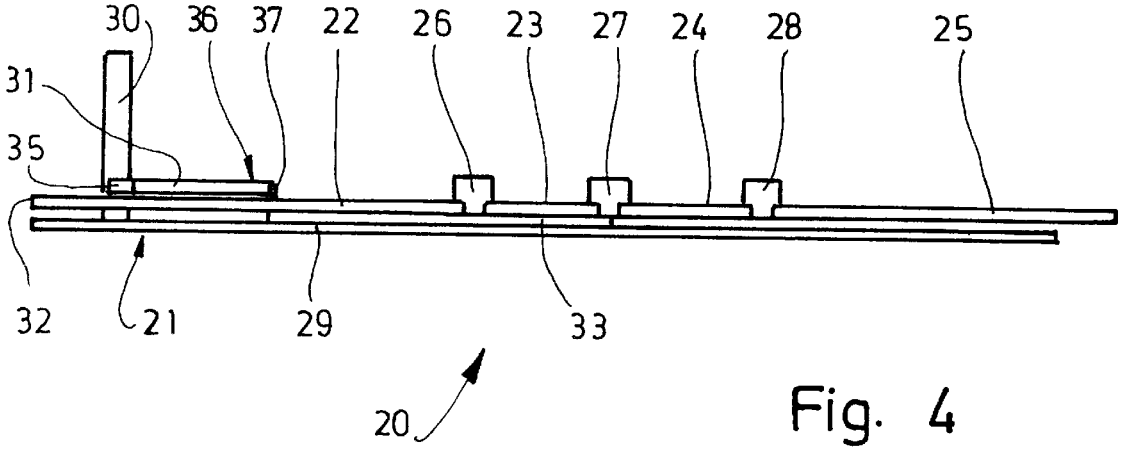
FIG. 4 shows the slatted base according to FIGS. 1 to 3 with a top element which has been pivoted into the horizontal position, in a view similar to FIG. 3.
Figure 5:
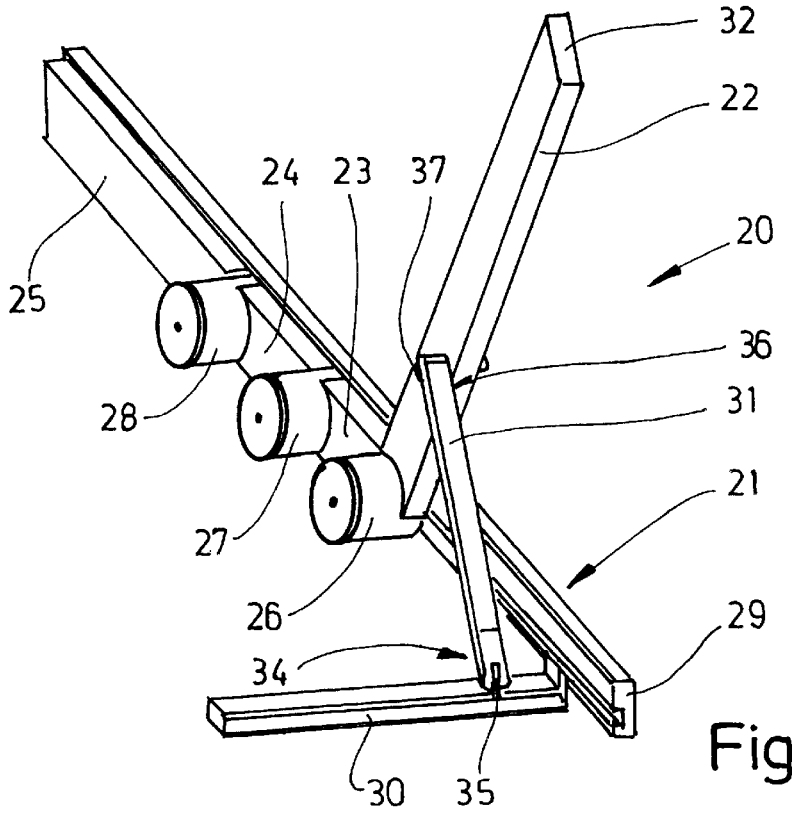
FIG. 5 shows the slatted base according to FIGS. 1 to 4 with a top view which has been pivoted into the inclined position, in a partial perspective rear view.
Figure 6:
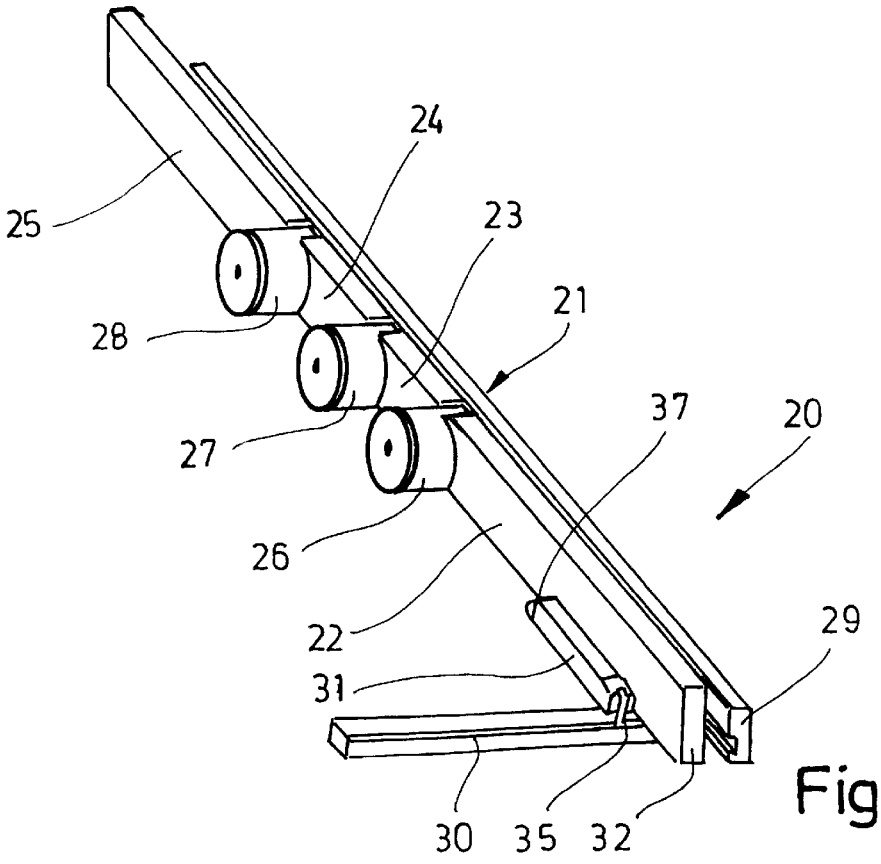
FIG. 6 shows the slatted base according to FIGS. 1 to 5 with a top element which has been pivoted into the horizontal position, in a view similar to FIG. 5.
Figure 7:
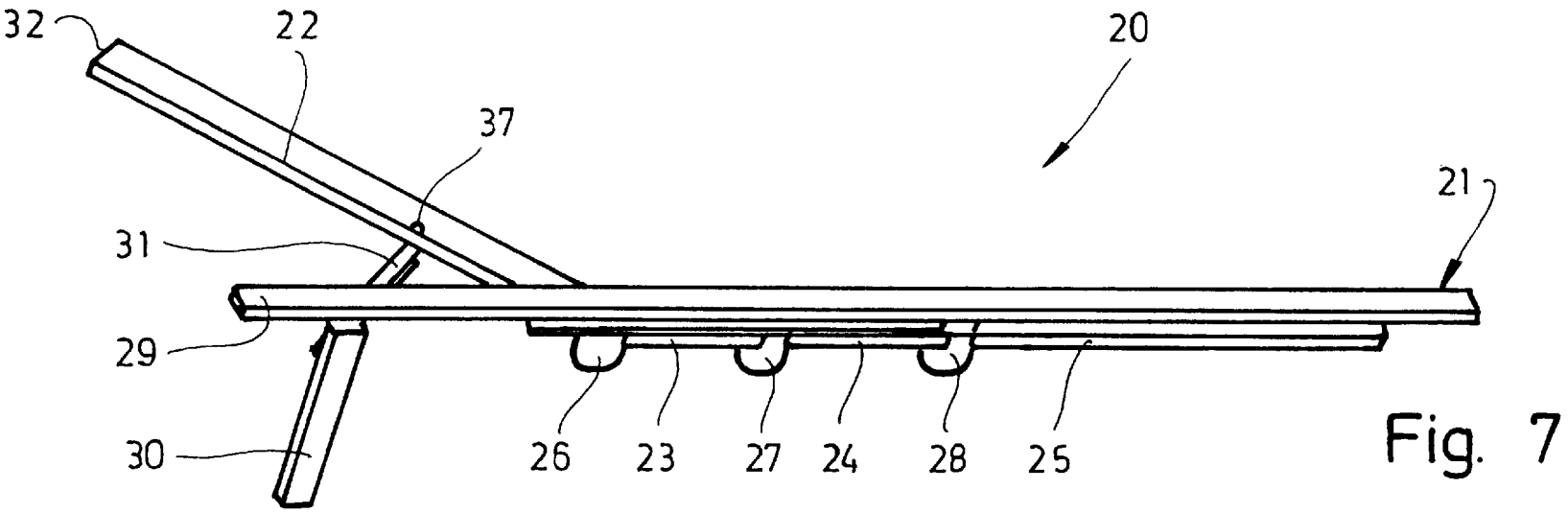
FIG. 7 shows the slatted base according to FIGS. 1 to 6 with a top element which has been pivoted into the inclined position, in a partial perspective bottom view.
Figure 8:
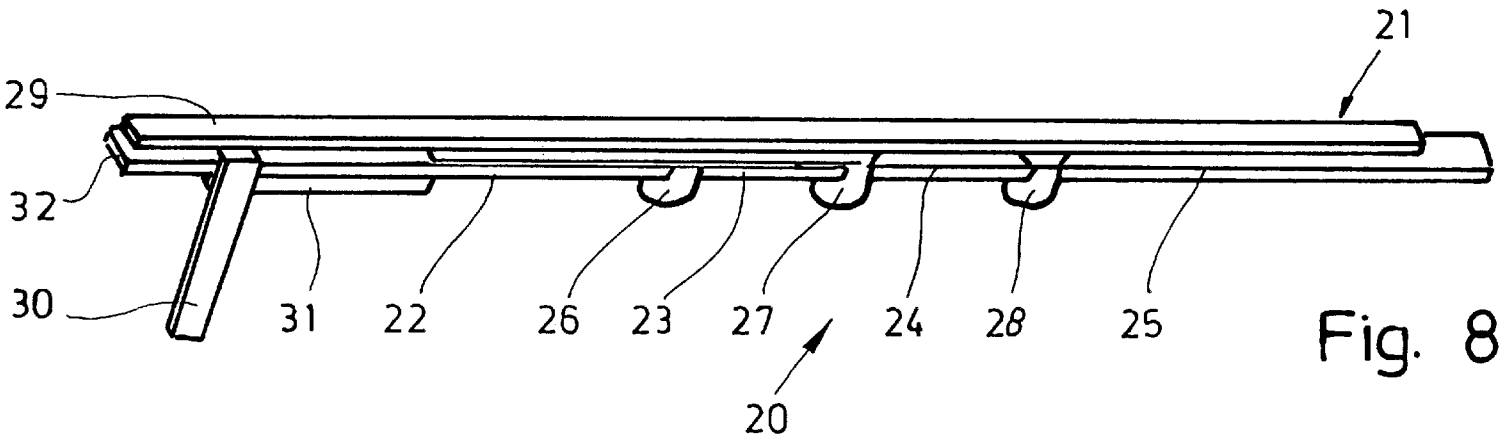
FIG. 8 shows the slatted base according to FIGS. 1 to 7 with a top element which has been pivoted into the horizontal position, in a view similar to FIG. 7.
Figures 9, 10:
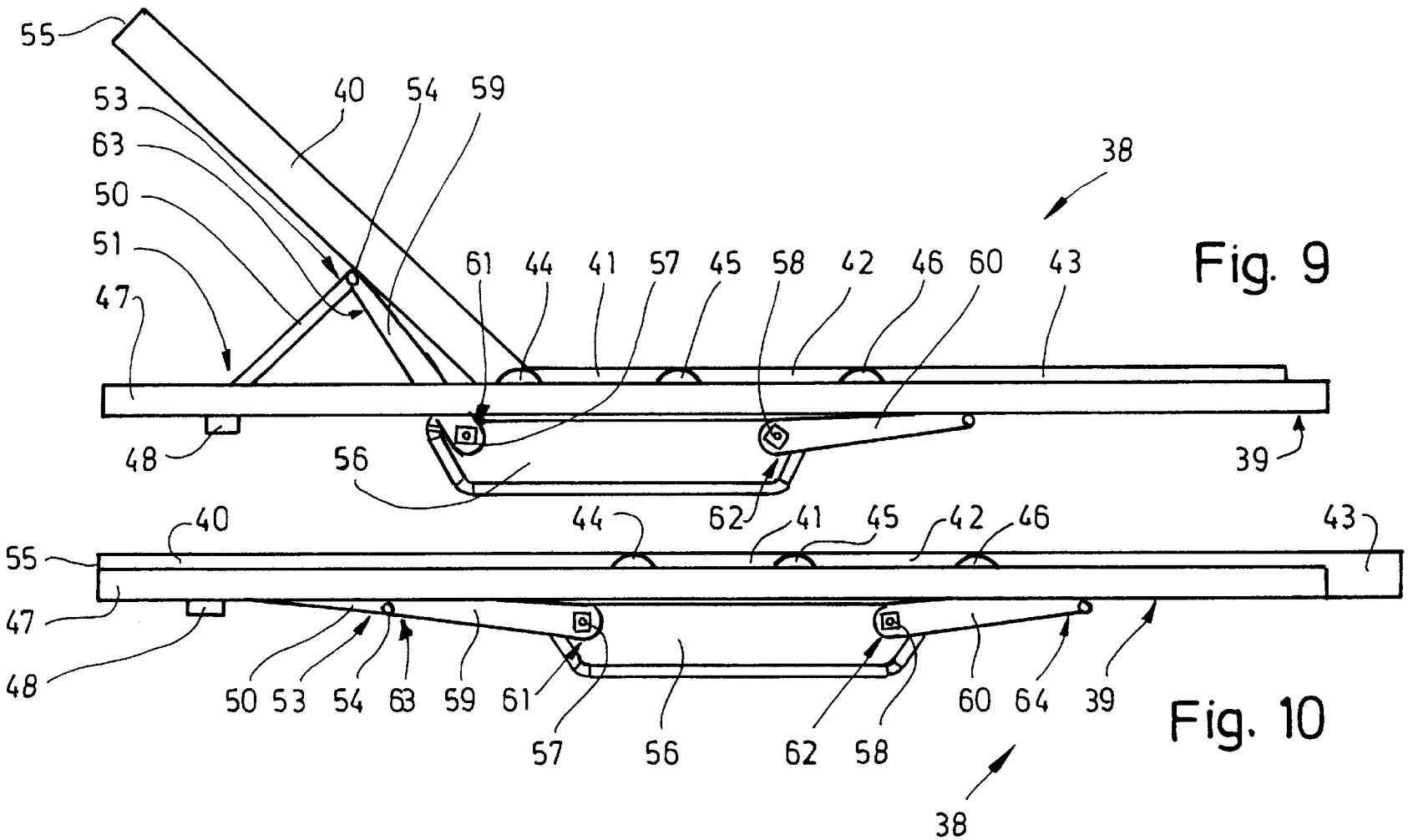
FIG. 9 shows a slatted base according to a second exemplary embodiment of the invention with a top element which has been pivoted into an inclined position, in a side view.
FIG. 10 shows the slatted base of FIG. 9 with a top element which has been pivoted into a horizontal position, likewise in a side view.
Figures 11, 12:
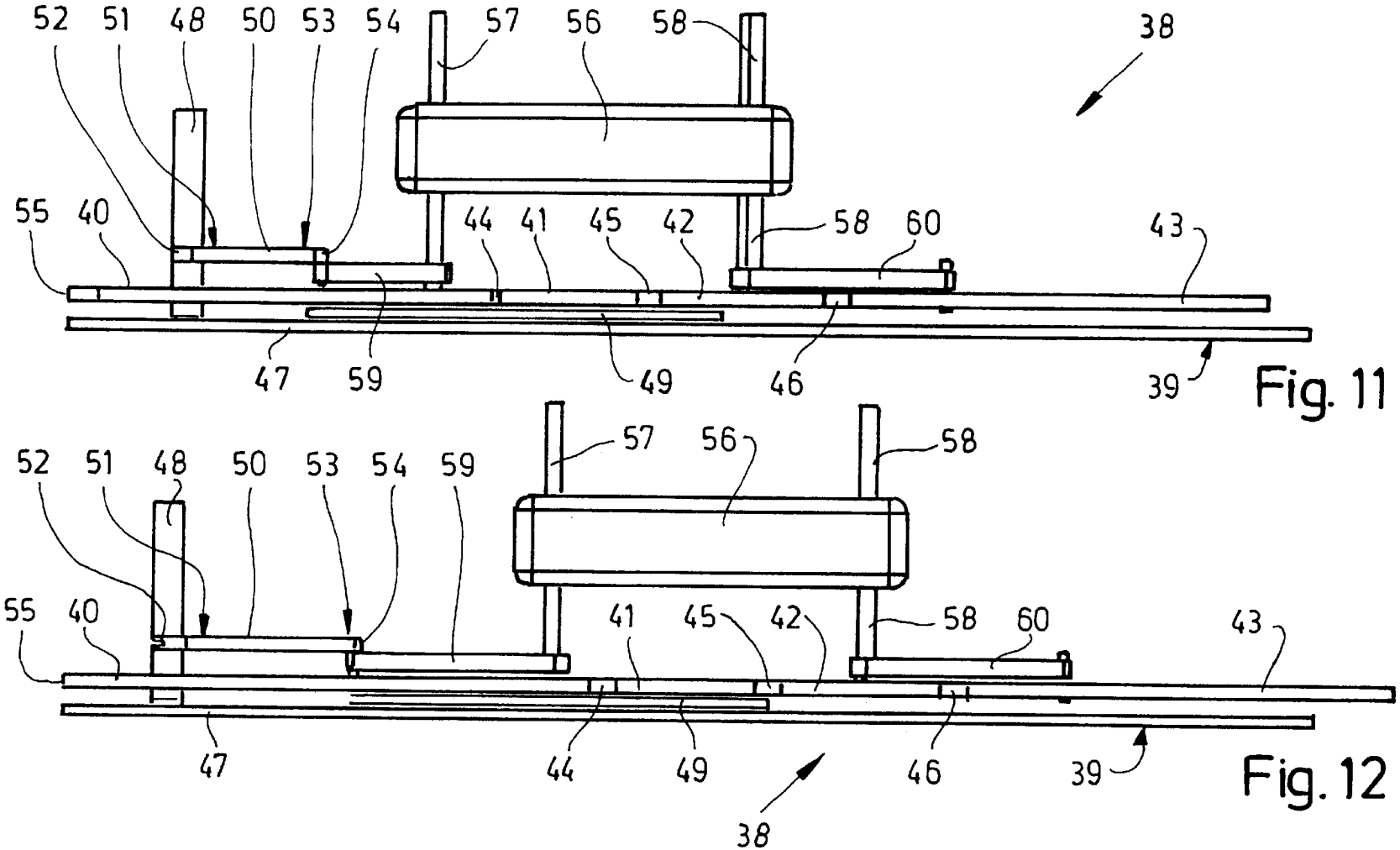
FIG. 11 shows the slatted base according to FIGS. 9 and 10 with a top element which has been pivoted into the inclined position, in a partial plan view.
FIG. 12 shows the slatted base according to FIGS. 9 to 11 with a top element which has been pivoted into the horizontal position, in a view similar to FIG. 11.
Figure 13:
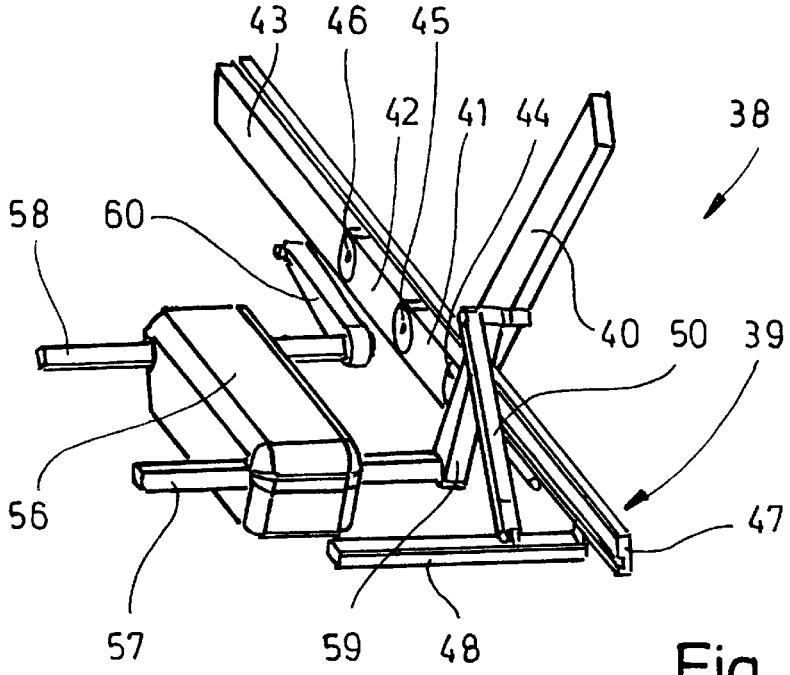
FIG. 13 shows the slatted base according to FIGS. 9 to 12 with a top element which has been pivoted into the inclined position, in a partial perspective rear view.
Figure 14:
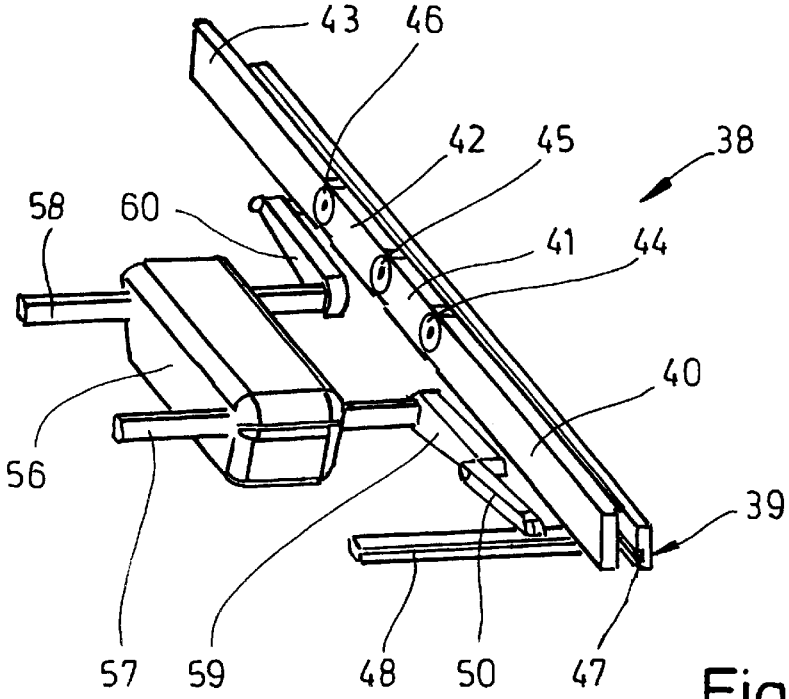
FIG. 14 shows the slatted base according to FIGS. 9 to 13 with a top element which has been pivoted into the horizontal position, in a view similar to FIG. 13.
Figure 15:
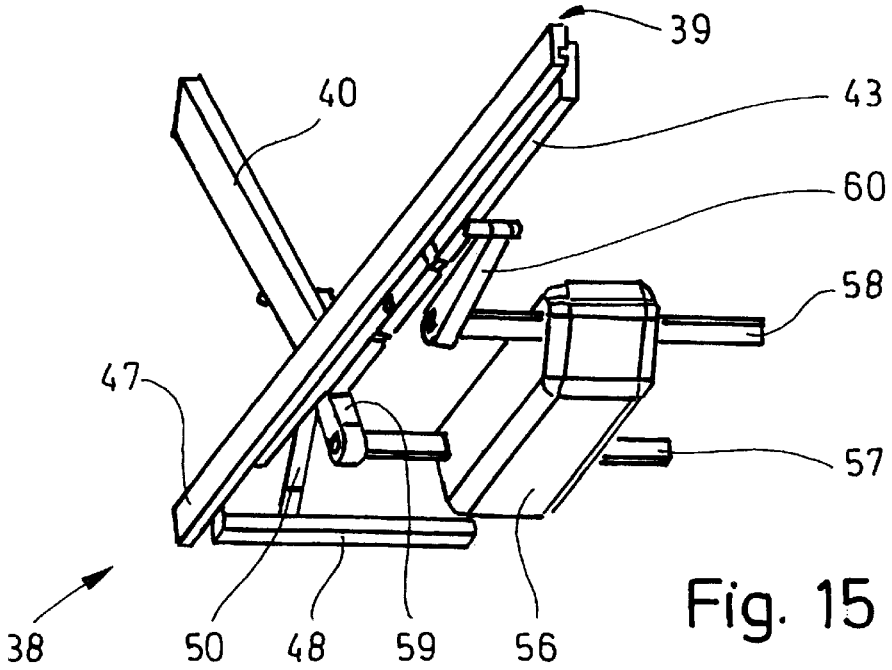
FIG. 15 shows the slatted base according to FIGS. 9 to 14 with a top element which has been pivoted into the inclined position, in a perspective bottom view.
Figure 16:
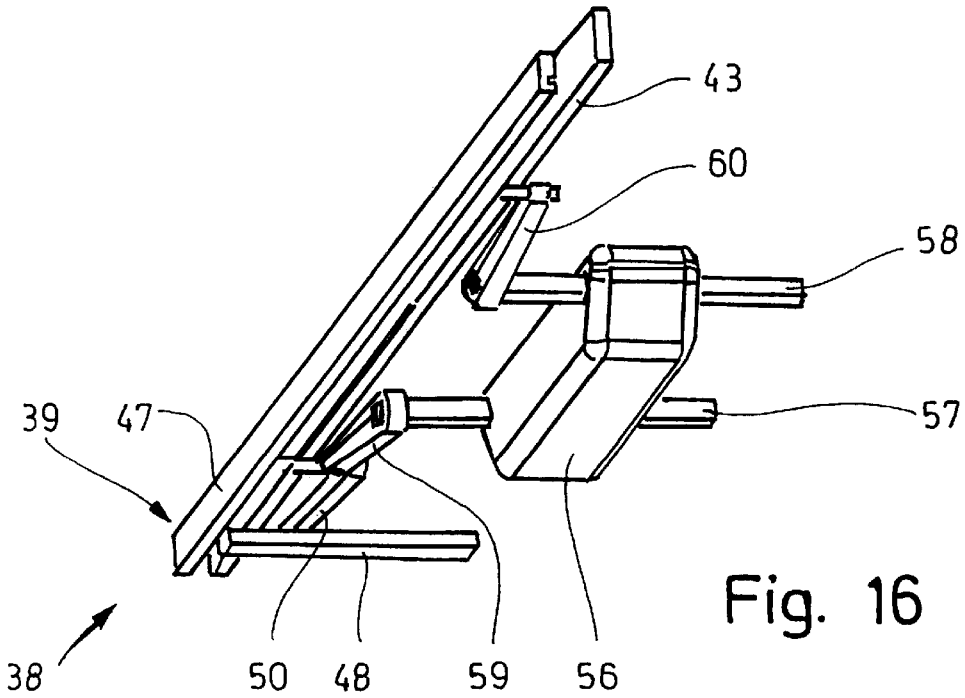
FIG. 16 shows the slatted base according to FIGS. 9 to 15 with a top element which has been pivoted into the horizontal position, in a view similar to FIG. 15.

When the element 22 is pivoted out of the horizontal position according to FIG. 2 into the inclined position according to FIG. 1, the element 22, which is connected at its end located opposite the free end 32 to the element 23 in the joint 26, is pivoted upwards about the joint 26. On account of the element 22 being connected to the frame 21 via the coupling member 31, a tensile force is exerted on the elements 22, 23, 24, 25 of the slatted base 20 in the direction of the free end 32 of the element 22. The element 23 guided in the guide rails 33 is thus displaced in the horizontal direction in the direction of the free end 32 of the element 22. In the process, on account of the articulated connection of the elements 22, 23, 24, 25, all the elements 22, 23, 24, 25 and joints 26, 27, 28 are moved in the direction of the free end 32 of the element 22. The horizontal component of the movement of the free end 32 which usually results when the element 22 is pivoted is thus compensated. The free end 32 of the element 22 is consequently only moved upwards and downwards in the vertical direction when the element 22 is pivoted. In contrast, the free end 32 of the element 22 cannot be displaced in the horizontal direction. Consequently, when the element 22 is pivoted, the coupling member 31 causes a forced displacement of all the elements 22, 23, 24, 25 in the direction of the free end 32 of the element 22. This forced displacement is made possible by the horizontal displaceability of the elements 22, 23, 24, 25.

Differing from the exemplary embodiment shown in accordance with FIGS. 1–8, it is also possible for the coupling members 31 not to be attached by the end section 34 to the frame 21, but to another means which cannot be pivoted in relation to the element 22 (top element). For instance, the coupling members 31 may also be attached by the end section 34 to a wall surface, floor surface or a foot part.

A drive, which is not illustrated in detail, is used to pivot the element 22. This drive is preferably configured as an electric motor and is positioned directly in the joint 26. The drive is capable of absorbing all the moments and forces arising. Consequently, virtually solely a tensile load acts on the coupling members 31 which cause the forced displacement of the elements 22, 23, 24, 25 when the element 22 is pivoted. All other moments and forces are absorbed by the drive. Consequently, the coupling members 31 may also be described as tension members. As is the case with the joint 26, drives which are not illustrated in detail are assigned to the joints 27, 28 in order to enable the elements 23, 24 and 24, 25 to be pivotable relative to each other. The fact that drives configured as electric motors are assigned respectively to the joints 26, 27, 28 is made clear in FIGS. 3 to 8 in that the joints 26, 27, 28 project clearly beyond the elements 22, 23, 24, 25.

The guide rails 33 have a slightly inclined course in relation to the longitudinal bars 29 of the slatted base 20. Inclination is dimensioned so as to facilitate the horizontal displaceability of the elements 22, 23, 24, 25 during a downward movement of the element 22 and thus when the element 22 is pivoted from the inclined position according to FIG. 1 into the horizontal position according to FIG. 2. Consequently, due to the inclined course of the guide rails 33, a force arises which facilitates the essentially horizontal displaceability of the element 23 in the slightly inclined guide rails 33 during the downward movement of the element 22 into the position according to FIG. 2. This restoring force can alternatively, however, also be brought about by the use of a spring element which assists the horizontal displaceability of the elements 22, 23, 24, 25 when the element 22 is pivoted into the horizontal position according to FIG. 2.

The coupling members 31 may be configured in different ways. For instance, it is possible to configure the coupling members 31 as cables. In this case, when the element 22—that is to say the top element—is pivoted into the inclined position, a tensile force is exerted by the cables in order to ensure the forced displacement of the elements 22, 23, 24, 25. However, when the element 22 is pivoted into the horizontal position, no restoring force can be transmitted by the cables. In this case, the spring elements already mentioned are provided for this purpose. The said spring elements cause the forced displacement of the other elements when the element 22 is pivoted into the horizontal position. Alternatively, it is also possible for the coupling members 31 to be configured as rods. When the element 22 is pivoted into the inclined position, the rods again exert a tensile force in order to ensure the forced displacement of the elements 22, 23, 24, 25. When the element 22 is pivoted into the horizontal position, compressive forces may also be exerted by the rods in order to cause the forced displacement of the elements 22, 23, 24, 25. In this case, both tensile forces and compressive forces consequently act on the coupling members 31 configured as rods. It is likewise possible to provide the mentioned spring elements in addition to the rods, so that the rods are subjected virtually exclusively to a tensile load.

A slatted base 38 according to a second exemplary embodiment of the invention is shown in FIGS. 9 to 16. The slatted base 38 shown in those figures also has a frame 39 and four elements 40, 41, 42, 43 connected to one another in an articulated manner. In each case two adjacent elements 40, 41 or 41, 42 or 42, 43 are again connected to one another by a joint 44, 45, 46 respectively. Like the frame 21 of the slatted base 20, the frame 39 of the slatted base 38 is formed by two longitudinal bars 47 extending parallel to one another and transverse bars 48 extending transversely to the longitudinal bars 47.

The element 40 is again configured as the top element, and the element 43 as the foot element. The elements 41, 42 are the seat elements and thigh elements already described in conjunction with the slatted base 20 according to FIGS. 1 to 8.

The elements 40, 41, 42, 43 of the slatted base 38 according to FIGS. 9 to 16 can be displaced horizontally in relation to the frame 39. For this purpose, the element 41 is mounted so as to be horizontally displaceable in guide rails 49 which are fixed to the longitudinal bars 47 of the frame 39. With regard to details concerning the design of the guide rails 49, reference is made to the descriptions given in relation to the guide rails 33 of the slatted base 20 according to FIGS. 1 to 8.

The element 40 to be pivoted—that is to say the top element—is connected on both sides to the frame 39 via a coupling member 50. For this purpose, the coupling members 50 are connected by a first end section 51 to the frame 39 by means of a first joint 52. Each of the coupling members 50 arranged next to the element 40 is connected by an end section 53, located opposite the first end section 51, by means of a second joint 54 to the element 40 to be pivoted. In this respect, the slatted bases 20 and 38 are of matching design. Consequently, in the slatted base 38 according to FIGS. 9 to 16, it is also ensured that, when the element 40 is pivoted, a free end 55 of the element 40 is only moved upwards and downwards in the vertical direction, while the free end 55 cannot be displaced in the horizontal direction.

The slatted base 38 according to FIGS. 9 to 16 differs from the slatted base 20 according to FIGS. 1 to 8 by the design of the drive for pivoting the elements 40, 41, 42, 43. Whereas, in the slatted base 20 according to FIGS. 1 to 8, each joint 26, 27, 28 of two adjacent elements 22, 23 or 23, 24 or 24, 25 is respectively assigned a separate drive, in the slatted base 38 according to FIGS. 9 to 16 a single drive 56 is provided to pivot the elements 40, 41, 42, 43. The drive 56 is preferably configured as an electric motor.

An axis of rotation 57, 58 on each side passes through the drive 56 in the horizontal direction. Each of the axes of rotation 57, 58 bears on each side a lever 59, 60 respectively. The levers 59 serve to pivot the element 40, that is to say the top element. The levers 60 serve to pivot the element 43, that is to say the foot element.

According to FIGS. 9 to 16, the levers 59 and 60 are attached by a first end 61 and 62 to the respective axis of rotation 57 and 58. The levers 59 and 60 are in contact, by ends 63, 64, located opposite the ends 61, 62, with the elements 40 and 43 to be pivoted. The end section 53 of the coupling member 50 and the end 63 of the lever 59 engage on the element 40 at a common point, namely the joint 54. The joint 54 is consequently a double joint. The levers 59, 60 can be pivoted independently of one another by means of the drive 56.

The coupling members 50 of the slatted base 39 may again be configured in different ways. It is possible to configure the coupling members 50 as rods or cables. In this regard, reference is made to the descriptions in relation to the slatted base 20 according to FIGS. 1–8. If the coupling members 31, 50 are configured as cables, their length is to be dimensioned such that the cable is virtually taut when the top elements (elements 22, 40) have been pivoted into the inclined position.

What is claimed is:

1. Slatted base for a bed having a frame with longitudinal bars, said slatted base comprising:

a. at least two elements connected to one another in an articulated manner;

b. at least one of said at least two elements being pivotable with respect to at least one other of said at least two elements;

c. the at least one other of said at least two elements being horizontally displaceable;

d. the pivotable element is connected to the frame by at least one coupling member so that when said pivotable element is pivoted, a free end of said pivotable element can be moved upwards and downwards in essentially in the vertical direction only;

e. the horizontally displaceable element is mounted in guide rails which are attached to the longitudinal bars; and f. the guide rails are inclined with respect to the longitudinal bars.

2. Slatted base according to claim 1, characterized in that an end, which is located opposite the free end (32; 55) of the pivotable element (22; 40), is connected to an adjacent element (23; 41) in an articulated manner.

3. Slatted base according to claim 2, characterized in that the end of the pivotable element (22; 40), which is connected to an adjacent element (23; 41) in an articulated manner, is horizontally displaceable with at least the adjacent element (23; 41).

4. Slatted base according to claim 1, characterized in that the guide rails (33; 49) are attached to the longitudinal bars (29; 47) of the frame (21; 39) so as to be non-displaceable.

5. Slatted base according to claim 1, characterized in that the coupling member (31; 50) is attached by a first end section (34; 51) to the frame (21; 39) or another fixed object and is attached by a second end section (36; 53), located opposite the first end section (34; 51), to the element (22; 40) to be pivoted.

6. Slatted base according to claim 5, characterized in that the first end section (34; 51) of the coupling member (31; 50) is connected by means of a first joint (35; 52) to the frame (21; 39) or another object, and the second end section (36; 53) of the coupling member (31; 50) is connected by means of a second joint (37; 54) to the element (22; 40) to be pivoted.

7. Slatted base according to claim 6, characterized in that the first joint (35; 52) is arranged on the frame (21; 39) or another object in a stationary manner, and the second joint (37; 54) is displaceable in relation to the frame (20; 39) together with the element (22; 40) to be pivoted.

8. Slatted base according to claim 1, characterized in that the element (22; 40) to be pivoted can be pivoted with the aid of a drive (56).

9. Slatted base for a bed having a frame with longitudinal bars, said slatted base comprising:

a. at least two elements connected to one another in an articulated manner;

b. one of said at least two elements is pivotable with respect to at least one other of said at least two elements;

c. the at least one other of said at least two elements is horizontally displaceable;

d. the pivotable element is connected to the frame by at least one coupling member so that when said pivotable element is pivoted, a free end of said pivotable element can be moved upwards and downwards in essentially the vertical direction only;

e. the horizontally displaceable element is mounted in guide rails that are attached to the longitudinal bars;

f. the guide rails are inclined with respect to the longitudinal bars; and g. assigned to the horizontally displaceable element is at least one spring element that acts upon the horizontally displaceable element in such a way that it supports the pivotability of the pivotable element in the horizontal direction.

* * * * *